US008591024B2

(12) United States Patent
Murray et al.

(10) Patent No.: US 8,591,024 B2
(45) Date of Patent: Nov. 26, 2013

(54) PRINTING APPARATUS WITH PIVOTABLE CLEANOUT MEMBER

(75) Inventors: Richard A. Murray, San Diego, CA (US); John Randall Fredlund, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 248 days.

(21) Appl. No.: 13/118,671

(22) Filed: May 31, 2011

(65) Prior Publication Data

US 2012/0306979 A1 Dec. 6, 2012

(51) Int. Cl.
*B41J 2/01* (2006.01)
*B41J 29/13* (2006.01)

(52) U.S. Cl.
USPC ..... 347/108

(58) Field of Classification Search
None
See application file for complete search history.

(56) References Cited

U.S. PATENT DOCUMENTS

| | | | | |
|---|---|---|---|---|
| 4,825,245 | A | 4/1989 | Fukae et al. | |
| 4,884,110 | A | 11/1989 | Tsurubuchi | |
| 5,455,616 | A * | 10/1995 | Ozawa et al. | 347/104 |
| 6,564,019 | B2 | 5/2003 | Ahn et al. | |
| 7,350,902 | B2 | 4/2008 | Dietl et al. | |
| 7,536,133 | B2 | 5/2009 | Kang | |
| 7,561,823 | B2 | 7/2009 | Johnson | |
| 7,744,077 | B2 | 6/2010 | Buxton et al. | |
| 2002/0114634 | A1 * | 8/2002 | Ahn et al. | 399/13 |
| 2007/0057448 | A1 * | 3/2007 | Hiura | 271/273 |

FOREIGN PATENT DOCUMENTS

| | | |
|---|---|---|
| JP | 2001-097603 | 4/2001 |
| JP | 2005-070070 | 3/2003 |
| JP | 2003-146476 | 5/2003 |

* cited by examiner

*Primary Examiner* — Laura Martin
*Assistant Examiner* — Tracey McMillion
(74) *Attorney, Agent, or Firm* — Eugene I. Shkurko; Amit Singhal

(57) ABSTRACT

A printing apparatus comprising a pivotable cleanout member attached to the housing using a hinge having an axis that is substantially perpendicular to the base. A latch holds the pivotable cleanout member in a closed position relative to the wall of the printing apparatus. On an opposite end of the cleanout member is a hinge mechanism that includes a pin member. The other part of the hinge is in the printer housing and includes a support member portion of the hinge mechanism.

15 Claims, 13 Drawing Sheets

PRINTING APPARATUS WITH PIVOTABLE CLEANOUT MEMBER

CROSS REFERENCE TO RELATED APPLICATIONS

Reference is made to commonly assigned, co-pending U.S. patent applications:

Ser. No. 13/118,651 by Chuang et al. filed of even date herewith entitled "Printing Apparatus With Pivotable Duplexing Unit";

Ser. No. 13/118,656 by Chuang et al. filed of even date herewith entitled "Printing Method with Pivotable Cleanout Member"; and Ser. No. 13/118,683 by Murray et al. filed of even date herewith entitled "Method Of Pivoting Cleanout Member", the disclosures of which are incorporated herein by reference in their entireties.

FIELD OF THE INVENTION

The present invention relates generally to a media path for a printing apparatus, and more particularly to a cleanout member for providing access to a portion of the media path between the media input holder and the print region.

BACKGROUND OF THE INVENTION

A printing apparatus typically includes a media advance system for advancing media from a media input holder to a print region. Because media can occasionally become jammed as it is being advanced through the printing apparatus, a cleanout member is provided in many printers. Typically an inner side of the cleanout member faces a portion of the media path. The cleanout member is conventionally configured to be removably mounted on the printing apparatus. If a media jam occurs, the user can remove the cleanout member to view and gain access to the jammed media. By manually taking hold of the jammed media, the user can remove it. The cleanout member is then reinstalled onto the printing apparatus and the printing job can continue.

Although a handle on the cleanout member usually makes it straightforward for the user to remove the cleanout member, reinstallation of the cleanout member can be nonintuitive. It can take several tries for the user to install the cleanout member correctly. Since the cleanout member typically forms one of the guide surfaces for a portion of the media path, if the cleanout member is not installed, the media can exit through the gap where the cleanout member should be and not make it to the print region. Thus, a cleanout member that is completely removed in order to clear media jams can be a source of frustration to the user during reinstallation.

A cleanout member that does not need to be completely removed from the printing apparatus in order to clear media jams can therefore be advantageous. A pivotable cleanout member that is attached to the printer housing by a hinge is advantaged because the user understands that after clearing the media jam he just needs to move the pivotable cleanout member to its closed position. There is no opportunity for the user to try to install such a cleanout member upside down or backwards.

U.S. Pat. No. 7,744,077 discloses a cleanout member (referred to there as a jam-door) having a hinge (or pivot) that is substantially parallel to the base of the printing apparatus. Since the base of the printing apparatus is horizontal during operation, such a hinge can also be called a horizontal hinge. The hinge in '077 is affixed to the housing of the printing apparatus at a position below the jam-door. Such a jam-door is opened by pivoting it downward. This is viable in the printing apparatus of '077 because the cleanout member is located somewhat above the base.

In a low-cost desktop printer, such as an inkjet printer, the printer is intended to sit on the user's desk or other flat surface that extends beyond the base of the printer. In addition, for a compact height printer having a C-shaped paper path (with the media input holder located below the media output holder), the cleanout member is typically located very close to the base of the printer. For a cleanout member located very close to the base of a desktop printer, a horizontal hinge configuration has disadvantages. If the hinge is located at the top of the cleanout member, the cleanout member would pivot upwards. However, since the user is typically taller than the desktop, the upwardly pivoted cleanout member would obscure visibility and interfere with access to the media path inside. Even if the user bent over so that his eyes were at desktop level, it would make it difficult to reach in and clear out paper jams between the upwardly pivoted cleanout member and the desktop. If the hinge is located at the bottom of the cleanout member (as in '077), the cleanout member would pivot downwards. However, if the cleanout member is located very near the base of the printing apparatus, its pivoting motion would typically cause it to hit the desktop before opening all the way, again interfering with visibility and access to the media path for clearing media jams.

What is needed is a cleanout member that does not require user installation, and that allows good visibility and access to media paths inside the printing apparatus in order to facilitate clearing out media jams.

SUMMARY OF THE INVENTION

A preferred embodiment of the present invention includes a printing apparatus comprising a base to support the printing apparatus during operation, a wall extending at an angle from the base, a print region, a media input holder, a media advance system for advancing media along a media path from the media input holder to the print region, and a pivotable cleanout member for allowing access to the media path between the media input holder and the print region, wherein the pivotable cleanout member is attached to the wall using a hinge having an axis that is substantially perpendicular to the base. A latch holds the pivotable cleanout member in a closed position relative to the wall of the printing apparatus. The latch can include a living hinge portion. On an opposite end of the cleanout member is a hinge mechanism that includes a pin member. The other part of hinge is in the printer housing and includes a support member portion of the hinge mechanism. The pin member of the hinge mechanism, formed in the cleanout member, pivots relative to the support member. The support member of the hinge mechanism includes a bearing surface that is substantially parallel to the base. The pin member includes a contact surface that makes pivotable contact with the bearing surface. A media input holder is substantially parallel to the base and located at a first plane proximate to the base. The print region is located at a second plane distal to the base. A pick roller advances a sheet of media from the input location, a turn roller further advances the sheet of media received from the pick roller toward the second plane, and a feed roller further advances the sheet of media to the print region for printing. The turn roller faces an inner side of the pivotable cleanout member when the pivotable cleanout member is in a closed position. The inner side of the pivotable cleanout member includes a concave curved surface with a pinch roller disposed therein. The pinch roller is disposed adjacent a turn roller in the printer when the pivotable cleanout member is in a closed position.

The pivotable cleanout member can include a first door and a second door hinged at opposite ends. An upper surface of the cleanout member is disposed distal to the base of the printing apparatus. The upper surface can be configured to guide media into the printing apparatus without being advanced past the curved inner side, thereby without bending the media.

Another preferred embodiment of the present invention includes a multifunction printer comprising a scanning apparatus and a printing apparatus. The printer apparatus comprises a base to support the multifunction printer during operation, a housing extending at an angle from the base, a print region, a media input holder, a media advance system for advancing media along a media path from the media input holder to the print region, and a pivotable cleanout member that allows access to the media path between the media input holder and the print region. The pivotable cleanout member is attached to the housing a hinge mechanism having an axis that is substantially perpendicular to the base. The housing includes a support surface and the pivotable cleanout member further comprises a pin member of the hinge mechanism for pivoting relative to the support member of the hinge. The housing can include a hole wherein an end of the pin member is disposed within the hole. The pivotable cleanout member includes a curved inner side and a feature disposed distal to the base of the printing apparatus, wherein the feature is configured to guide media into the printing apparatus without bending the media.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. For example, the summary descriptions above are not meant to describe individual separate embodiments whose elements are not interchangeable. In fact, many of the elements described as related to a particular embodiment can be used together with, and possibly interchanged with, elements of other described embodiments. Many changes and modifications may be made within the scope of the present invention without departing from the spirit thereof, and the invention includes all such modifications. The figures below are intended to be drawn neither to any precise scale with respect to relative size, angular relationship, or relative position nor to any combinational relationship with respect to interchangeability, substitution, or representation of an actual implementation.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
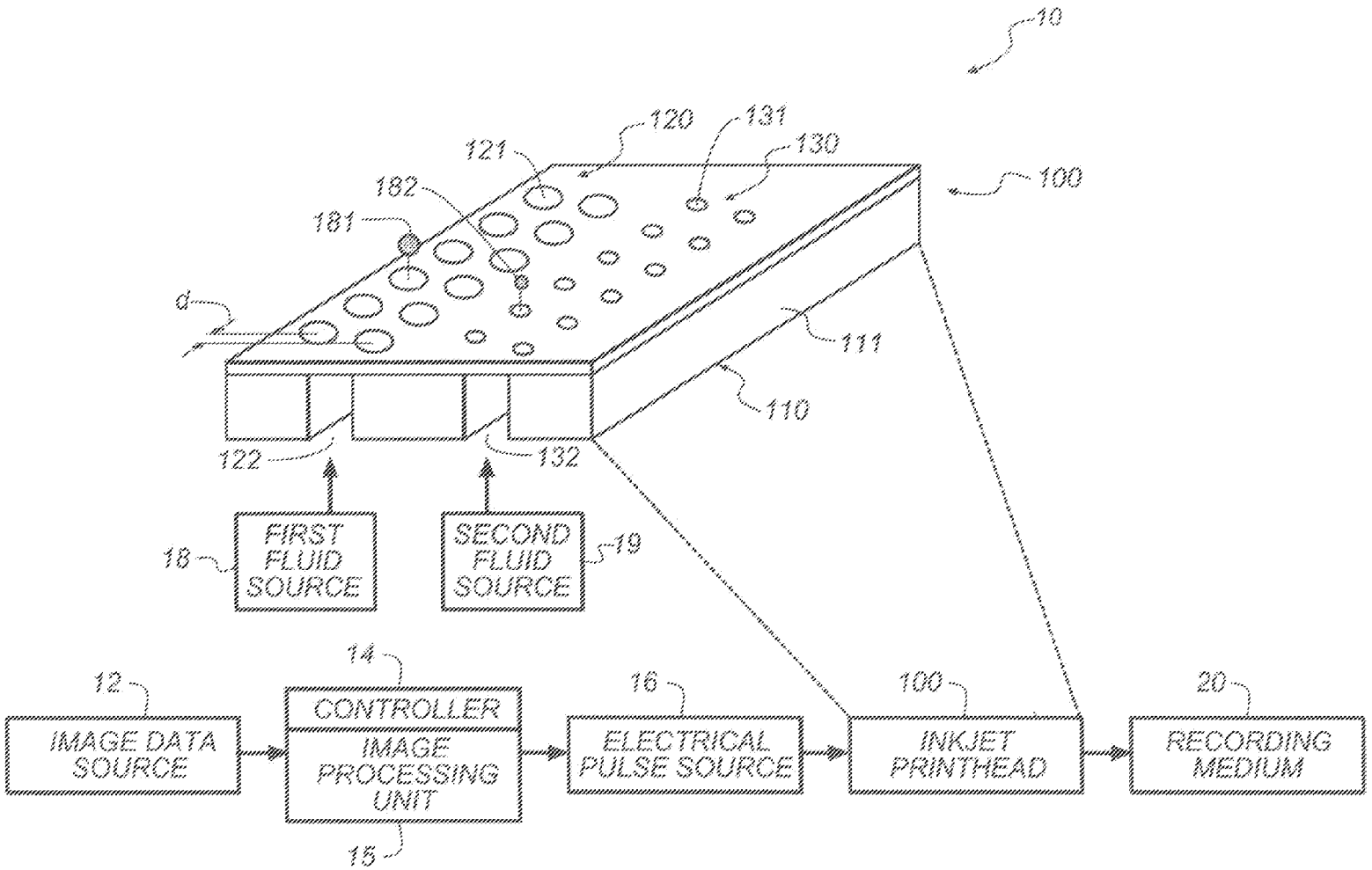
FIG. 1 is a schematic representation of an inkjet printer system.

Referring to FIG. 1, a schematic representation of an inkjet printer system 10 is shown, for its usefulness with preferred embodiments of the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some preferred embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
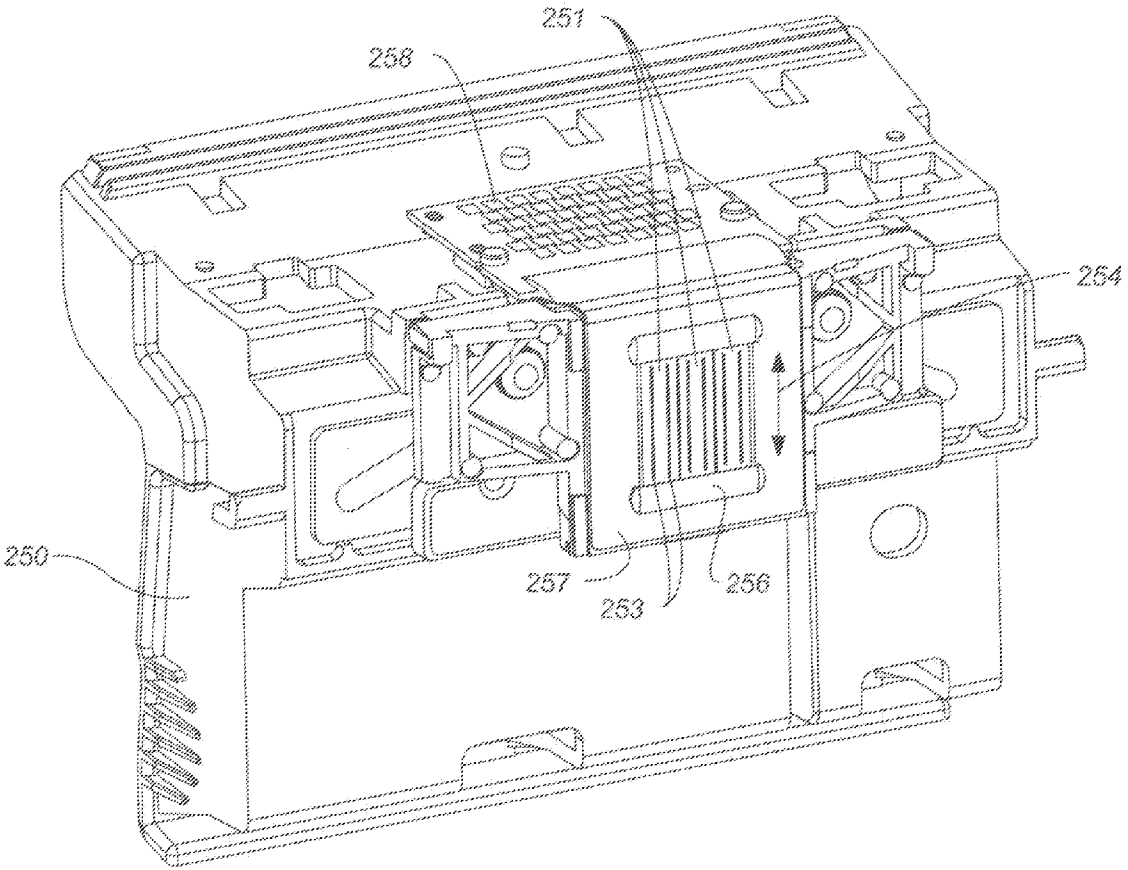
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110 in FIG. 1), each printhead die 251 containing two nozzle arrays 253, so that printhead chassis 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals can be transmitted to the printhead die 251.

Figure 3:
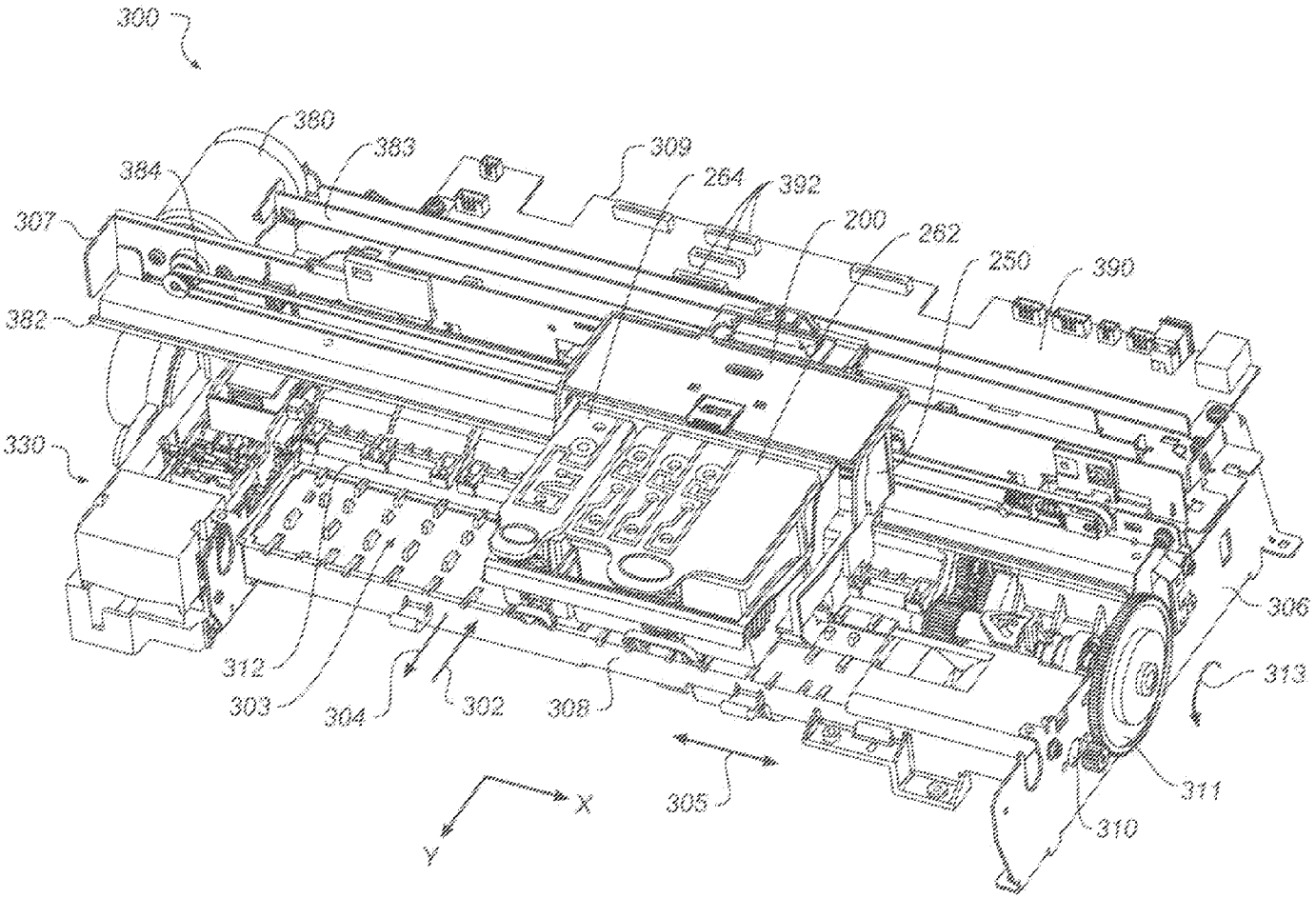
FIG. 3 is a perspective view of a portion of a desktop carriage printer.

FIG. 3 shows a portion of a desktop carriage printer. Some of the parts of the printer, including the housing, have been hidden in the view shown in FIG. 3 so that other parts can be more clearly seen. Printing apparatus 300 has a print region 303 across which carriage 200 is moved back and forth in carriage scan direction 305 along the X axis, between the right side 306 and the left side 307 of printing apparatus 300, while drops are ejected from printhead die 251 (not shown in FIG. 3) on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink tank 262 and single-chamber ink tank 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. Paper or other recording medium (sometimes generically referred to as paper or media herein) is loaded along paper load entry direction 302 toward the front of printing apparatus 308.

The motor that powers the media advance rollers is not shown in FIG. 3, but the hole 310 at the right side of the printing apparatus 306 is where the motor gear (not shown) protrudes through in order to engage feed roller gear 311, as well as the gear for the discharge roller (not shown). A forward direction of rotation 313 is indicated. Toward the rear of the printing apparatus 309 is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 4:
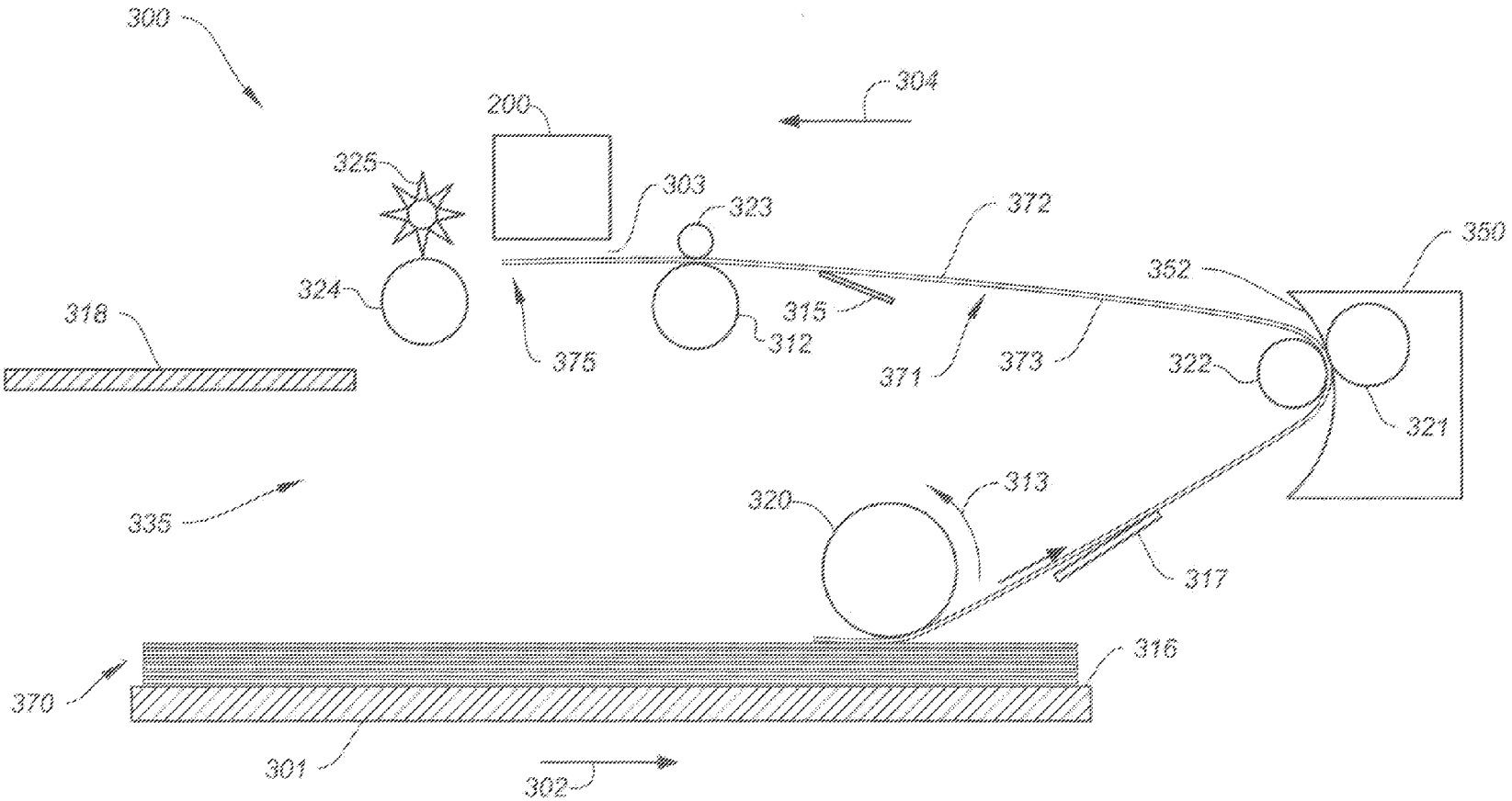
FIG. 4 is a schematic side view of an exemplary media path in a carriage printer that includes a cleanout member.

The media advance system 335 includes a variety of rollers that are used to advance the medium through the printer as shown schematically in the side view of FIG. 4. In this example, a media input holder 316, which is located at a plane near the base 301 and is substantially parallel to base 301, holds a stack of media 370. A pick roller 320 is driven to rotate in forward rotation direction 313 to advance the top sheet 371 of the stack of media 370 from media input holder 316 along paper load entry direction 302 and up inclined guide 317. A turn roller 322 is driven to further advance the sheet of media 371 received from the pick roller around a C-shaped path, in cooperation with a curved inner side 352 of cleanout member 350 and a pinch roller 321. As a result, the sheet 371 continues to advance along media advance direction 304 from the rear 309 of the printing apparatus (with reference also to FIG. 3) toward the print region 303 that is located at a plane that is farther from base 301 than the media input holder 316 is. The sheet 371 is then advanced by feed roller 312 (driven to rotate in forward rotation direction 313) and idler roller(s) 323 to advance the lead edge 375 of sheet 371 to and across print region 303 for printing on first side 372 of sheet 371, and from there to a discharge roller 324 and star wheel(s) 325. Discharge roller 324 is driven in forward rotation direction 313 to continue to advance sheet 371 along media advance direction 304 until sheet 371 exits into optional media output holder 318, a portion of which is shown in FIG. 4. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller. A media end sensor 315 is positioned near feed roller 312 between turn roller 322 and feed roller 312 in order to detect when lead edge 375 is approaching the feed roller 312. In FIG. 4, the sheet 371 has pushed the media end sensor 315 down.

Preferred embodiments of the present invention relate to configurations where cleanout member 350 is pivotable and attached to a wall 319 (FIG. 5), e.g. a housing, of the printing apparatus 300 using a hinge 340 having a vertical axis 341 that is substantially perpendicular to horizontal base 301. Thus, rather than pivoting upward or downward relative to the base 301, pivotable cleanout member 350 swings outward along a horizontal plane, sweeping out a path in the horizontal plane that is parallel to horizontal base 301. Therefore pivotable cleanout member 350 can be opened fully without interfering with the surface upon which base 301 rests, even though it is located close to the base 301. Opening the pivotable cleanout member 350 outward also does not result in the cleanout member 350 obscuring visibility of media paths inside printing apparatus 300. Thus the configuration of vertical hinge 340 with its vertical axis 341 perpendicular to horizontal base 301 is advantageous, especially for desktop printers having the cleanout member located close to the base 301.

Figure 5:
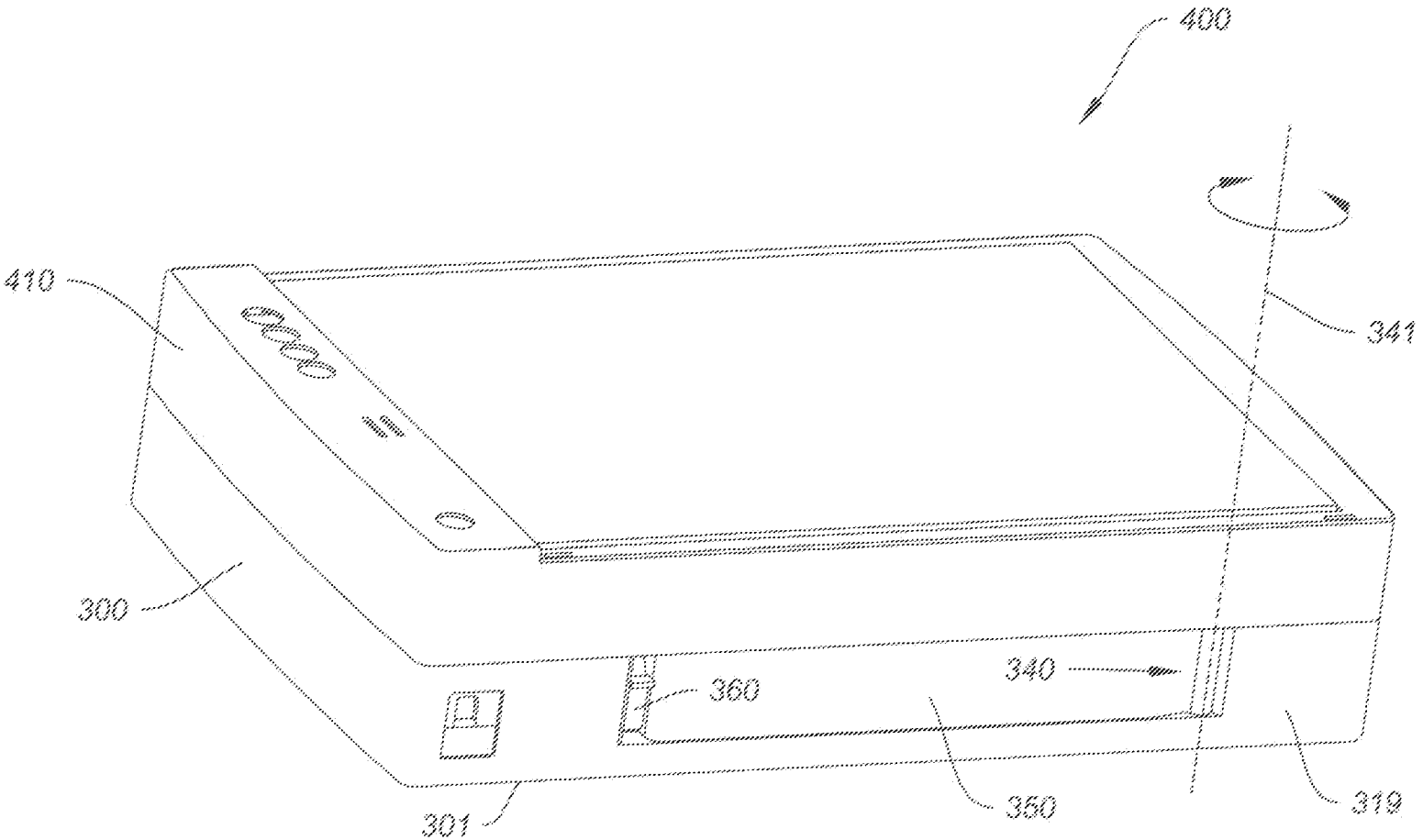
FIG. 5 is a perspective rear view of a multifunction printer including a scanning apparatus, a printing apparatus and a pivotable cleanout member, according to a preferred embodiment of the invention.

FIG. 5 shows a rear perspective view of a multi-function printer 400 that includes a scanning apparatus 410 for scanning documents, such that scanning apparatus 410 is mounted on top of a printing apparatus 300. With reference to FIGS. 4 and 5, according to a preferred embodiment of the invention, printing apparatus 300 includes a horizontal base 301 to support the printing apparatus 300 (and the multi-function printer 400) during operation; a wall or housing 319 that extends at an angle from base 301; a print region 303; a media input holder 316; a media advance system 335 for advancing media along a media path from the media input holder 316 to the print region 303; and a pivotable cleanout member 350 for allowing access to the media path between the media input holder 316 and the print region 303, such that the pivotable cleanout member 350 is attached to the wall 319 using a hinge 340 having an axis 341 that is substantially perpendicular to the base 301. The rotation directions of the pivotable cleanout member 350 are indicated by the double headed curved arrow around axis 341. For a compact height printing apparatus 300, pivotable cleanout member 350 is located close to the base 301. Because the bottom of cleanout member 350 remains parallel to base 301 as the unit is pivoted open, opening the cleanout member 350 to a full open position (for example, the position shown in FIG. 7) does not interfere with the desktop, as the jam door disclosed in U.S. Pat. No. 7,744,077 could if it were located very close to the base of the printer. FIG. 5 also shows a latch 360 for holding the pivotable cleanout member 350 in its closed position relative to wall 319 (the position shown in FIG. 5).

Figure 6:
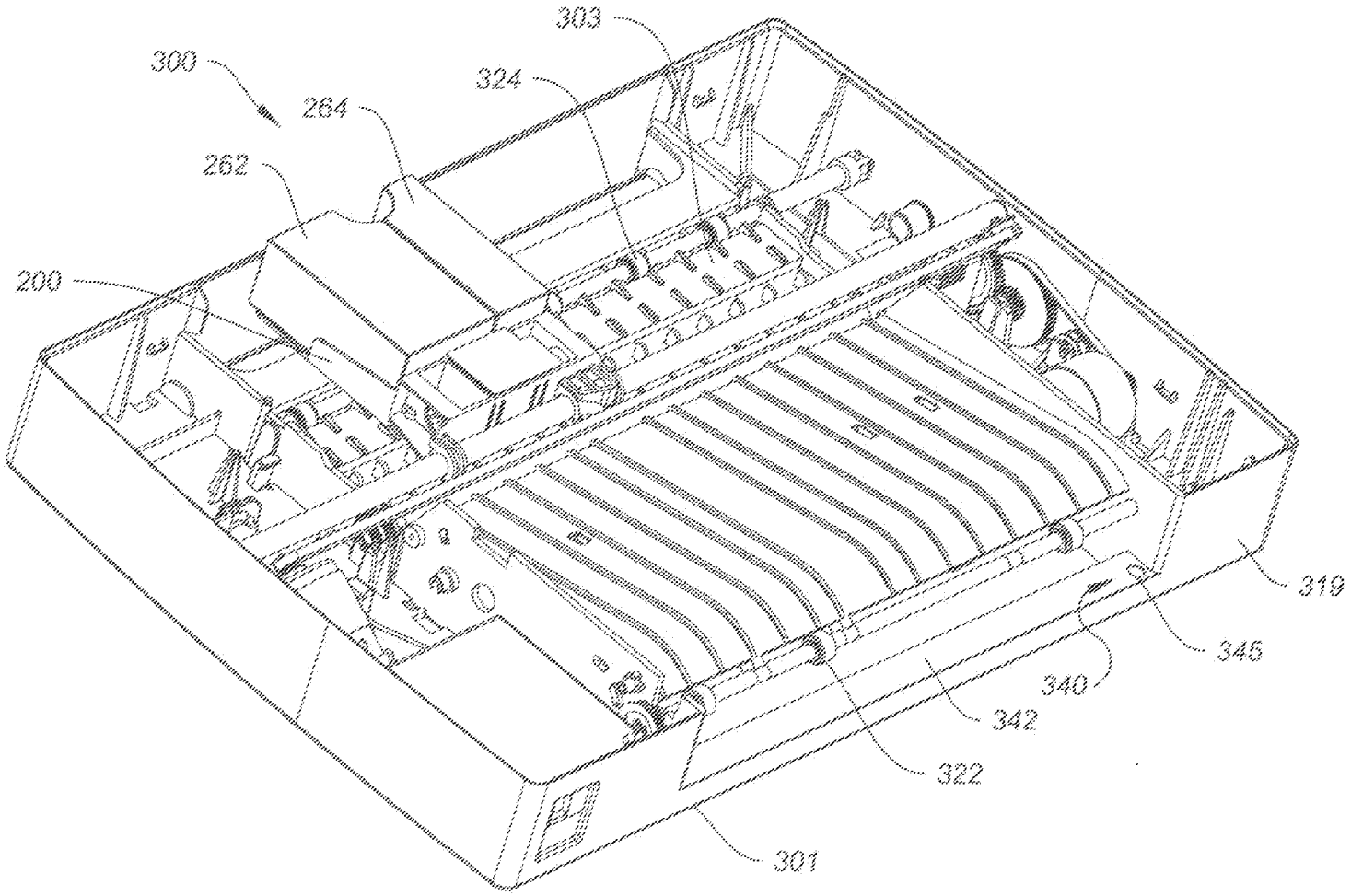
FIG. 6 is a perspective view of the multifunction printer of FIG. 5, but with the scanning apparatus and the pivotable cleanout member hidden.
Figure 10:
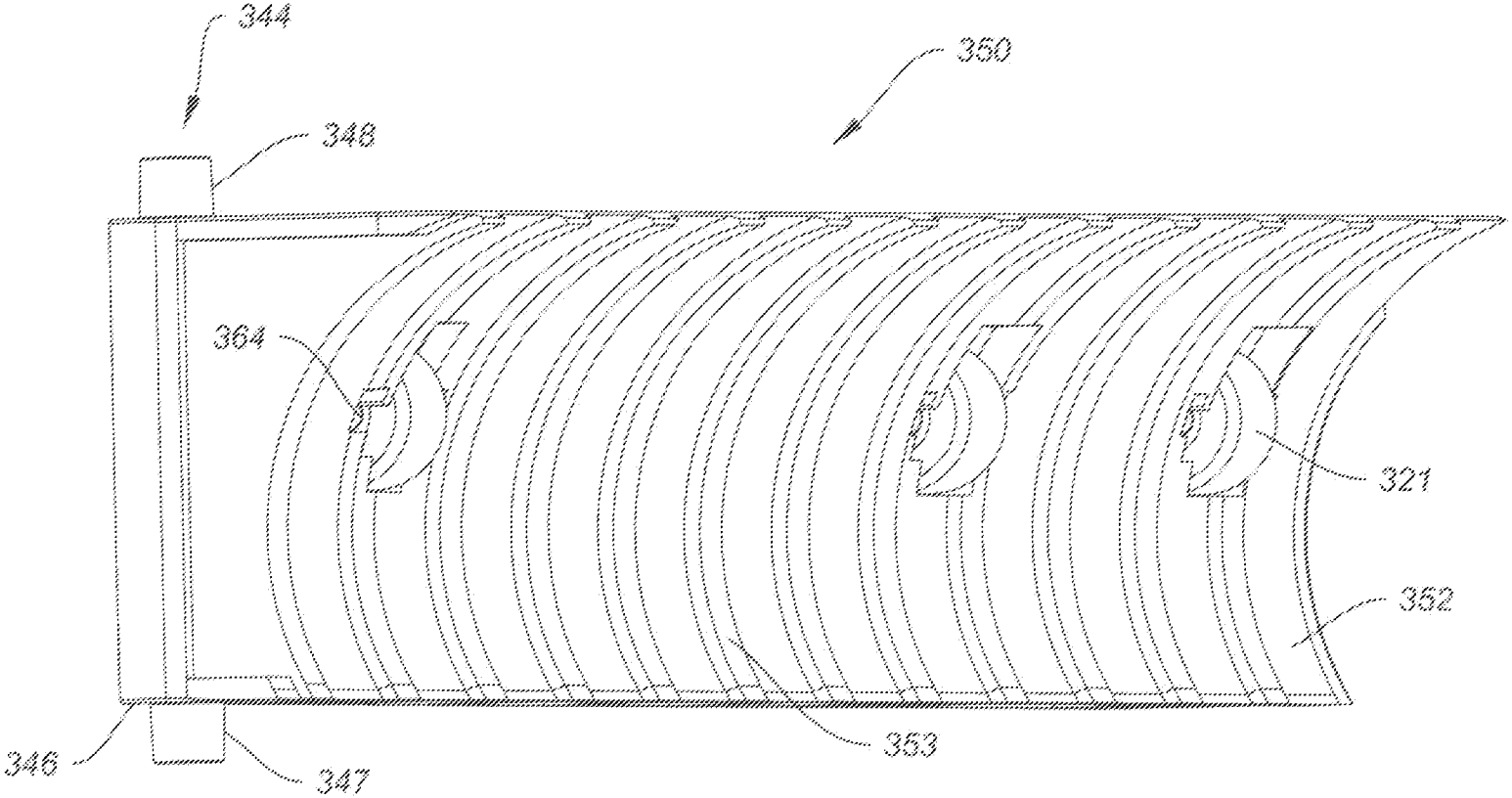
FIG. 10 is a close-up perspective view of the inner side of the pivotable cleanout member, according to a preferred embodiment of the invention.

FIG. 6 shows the printing apparatus 300 of FIG. 5, but with both the scanning apparatus 410 and the cleanout member 350 hidden from view. With the scanning apparatus hidden, a number of internal components of the printing apparatus are visible, including the carriage 200, the multichamber ink tank 262, the single chamber ink tank 264, the print region 303, the turn roller 322 and the discharge roller 324. With the cleanout member 350 hidden, the portion of the media path in the vicinity of the turn roller 322 is visible. With reference also to FIG. 4, turn roller 322 faces the curved surface of inner side 352 of pivotable cleanout member 350 when pivotable cleanout member is in its closed position as in FIG. 5. With reference also to FIGS. 4 and 10, pivotable cleanout member 350 includes a pinch roller 321 at its inner side 352, such that the pinch roller 321 is disposed adjacent the turn roller 322 when the pivotable cleanout member 350 is in its closed position. Another portion of housing 319 includes a support surface 342 for the hinge mechanism 340. An opening 345 is formed within horizontal surface 342 for receiving a bottom first end 347 of pin member 344 (FIG. 10) to form a bottom portion of hinge mechanism 340. For a hinge mechanism 340 of the type shown in FIGS. 6 and 10 where a first end 347 of pin member 344 is inserted into opening 345, the area surrounding opening 345 in support surface 342 provides a bearing surface. Bearing surface 342 is substantially parallel with base 301. First end 347 of pin member 344 includes a contact surface 346 that makes pivotable contact with bearing surface 342. Pin member 344 also includes an upper second end 348 opposite first end 347, as described in further detail below.

Figure 7:
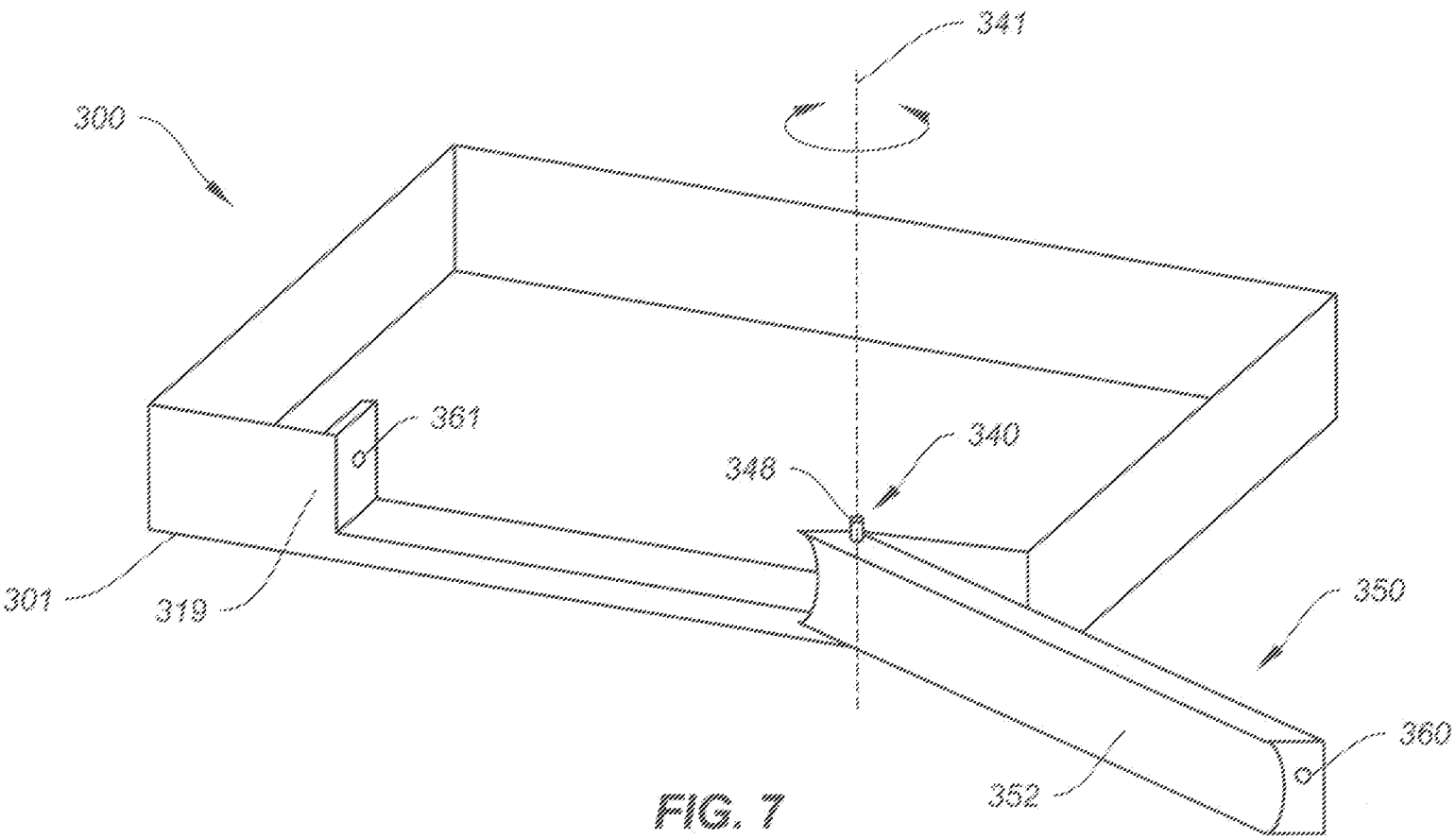
FIG. 7 schematically shows a portion of the printing apparatus with a pivotable cleanout member in an open position, according to a preferred embodiment of the invention.

FIG. 7 schematically shows portions of a printing apparatus 300 having a pivotable cleanout member 350 that is in an open position in order to allow access to the media path inside the printing apparatus for clearing paper jams. A variety of types of latches and catches can be used to secure the pivotable cleanout member into its closed position. In the example of FIG. 7, latch 360 includes a projection formed on or attached to one end of pivotable cleanout unit 350, and catch 361 includes a hole formed in a portion of wall 319.

Figure 8:
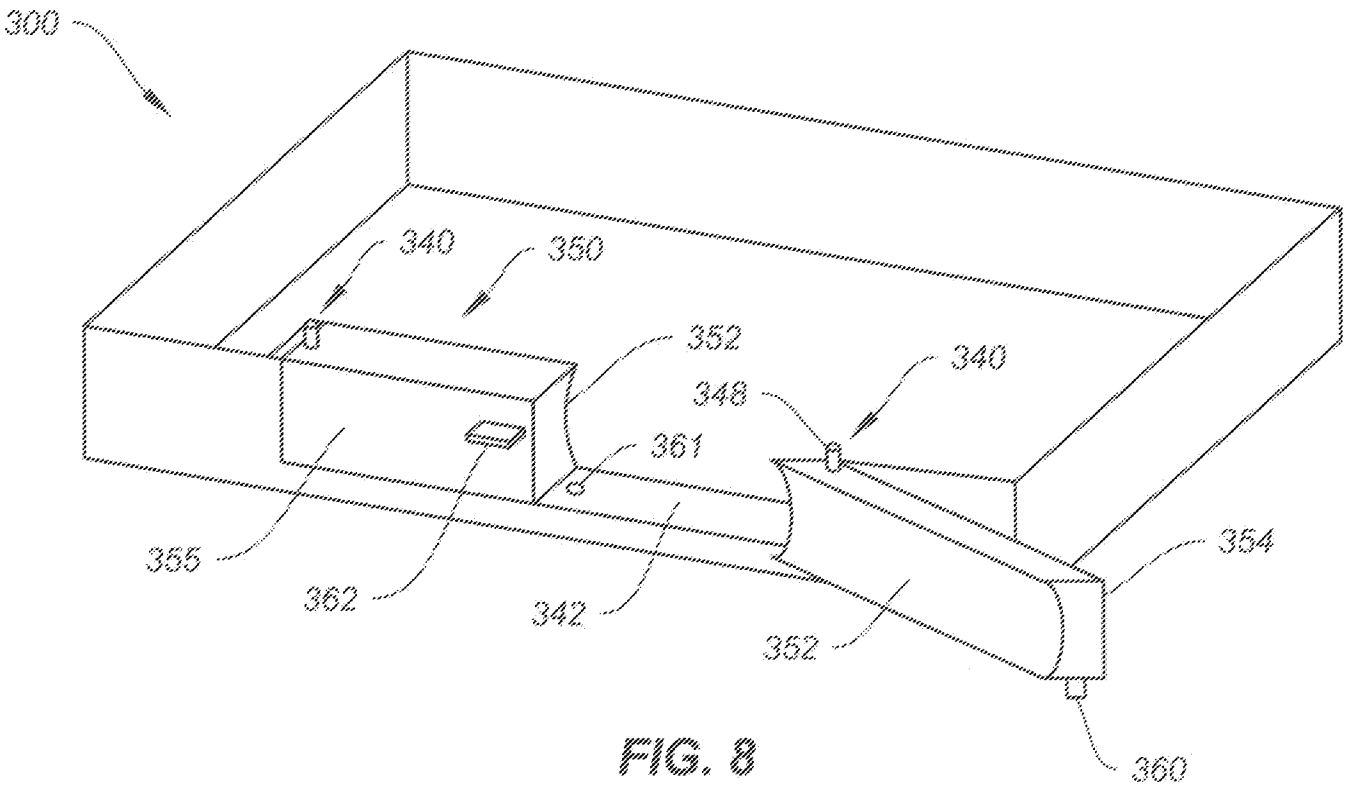
FIG. 8 schematically shows a preferred embodiment in which the pivotable cleanout unit includes two half doors FIG. 9A schematically shows the embodiment of FIG. 8 but with the two half doors positioned in an open position substantially perpendicular to a wall of the printing apparatus.
Figure 9A:
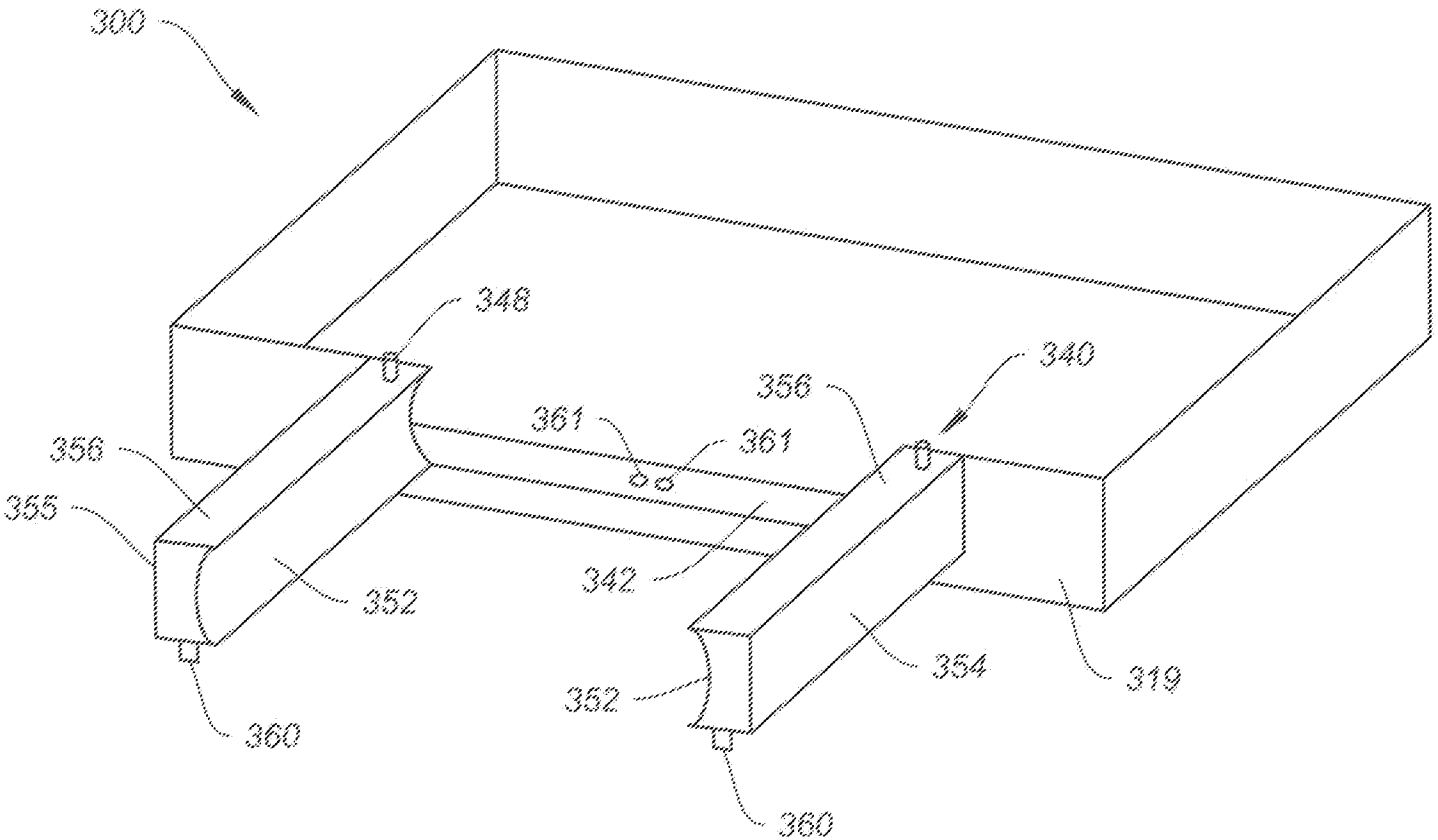
FIG. 9B schematically shows the embodiment of FIG. 9 but with the two half doors showing guide features.

In the example of FIG. 7, the pivotable cleanout member 350 requires significant space behind printing apparatus 300 in order to pivot it into its open position. FIG. 8 shows a preferred embodiment of the pivotable cleanout member 350 including two half doors 354 and 355. Half doors 354 and 355 are hinged at opposite ends, so that in this preferred embodiment, the pivotable cleanout member opens in its middle portion. A handle 362 can optionally be provided to assist the opening of the pivotable cleanout member 350. Half door 354 is shown in its open position, while half door 355 is shown in its closed position. Each of the half doors 354 and 355 includes a hinge mechanism 340, a curved inner side 352, and a latch 360. In this example, latch 360 includes a projection formed on the bottom of each of the half doors 354 and 355 (see also FIG. 9), and catch 361 includes holes in support surface 342 corresponding to the projection from each of the half doors. An advantage of the configuration of the preferred embodiment of FIG. 8 is that each of the half doors 354 and 355 only needs to be about half as long as the entire cleanout member 350 shown in FIG. 7. As a result, not as much space is required behind printing apparatus 300 to open half doors 354 and 355 relative to the configuration shown in FIG. 7.

A further advantage that can be provided in preferred embodiments such as the one shown in FIG. 8 is that the opened half doors 354 and 355 can provide a media guide surface for feeding media directly from the rear of printing apparatus 300, without the media needing to bend around the C shaped path shown in FIG. 4. This can be advantageous for feeding stiff media for printing. For example, the upper surfaces 356 (FIG. 9A) of the two half doors 354 and 355 can provide support for feeding media from the rear of printing apparatus 300 above the curved part of the media path corresponding to the curved inner sides 352. Although the half doors 354 and 355 are shown substantially perpendicular to the wall 319 of printing apparatus 300 in FIG. 9A, in some instances it can be advantageous to open the half doors 354 and 355 to a lesser extent (for example at an angle of around 45 degrees to the wall 319) in order to provide additional support to the middle region of media, rather than just near the edges. The inner edges of upper second ends 348 of pin members 344 can be used to guide the side to side position of media fed from the rear.

Figure 9B:
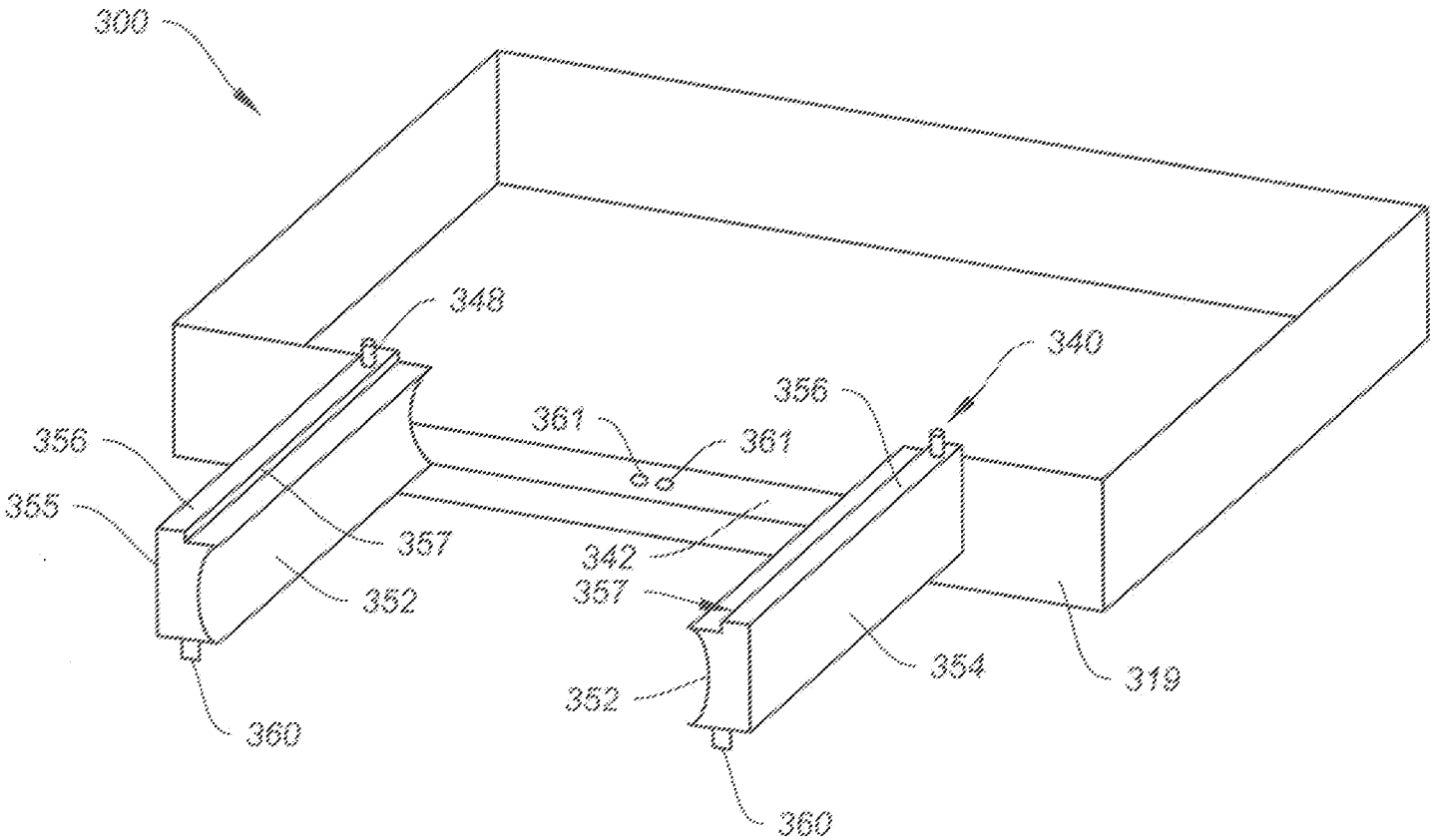

As shown in FIG. 9B, there can be other guide features 357 built into the upper surfaces 356. Guide features 357 are provided in upper surfaces 356 to guide media into the printer in a manner that does not require the media to bend. This facilitates printing of heavy stock that is not well suited to bending around turn roller 322. This preferred embodiment provides support and guidance on both edges of the media inserted. In the preferred embodiment shown, guide features 357 are located at the top of the doors 354 and 355. Other locations for guide feature position (not shown) on other surfaces of doors 354 and 355 are also possible.

In the implementation of preferred embodiments of the invention shown in FIG. 7 using a single door 350, the door can be modified to provide a feature to guide and support the media, but will be limited to a single side and will rely on the user to provide the remainder of the support and guidance.

Implementations of guide features 357 can also be augmented with position limits for doors 354 and 355, or door 350. Position limits can be created with detents or interferences well known in the art that will provide stop positions for the doors that will situate guide features such that media will be fed into the printing path in the proper registration with minimal skew.

FIG. 10 shows a close-up perspective view of the curved inner side 352 of a preferred embodiment of the pivotable cleanout member 350. Bottom first end 347 and upper second end 348 of pin member 344 are shown, as is contact surface 346 for making contact with the bearing surface 342 that is shown in FIG. 6. Pinch rollers 321 are mounted at mounts 364 on pivotable cleanout member 350 and extend past curved inner side 352 for holding the media against turn rollers 322 (FIGS. 4 and 6) as the media is advanced toward feed roller 312. Ribs 353 also extend from curved inner side 352 in order to provide less frictional drag against the media. A further advantage of ribs 353 in the context of preferred embodiments using half doors (as in FIGS. 7 and 8) is that any gap between the half doors when they are closed will not be contacted by the media, but rather, just the spaced apart ribs. Thus there is less chance of media catching on an edge of a half door.

Figure 11:
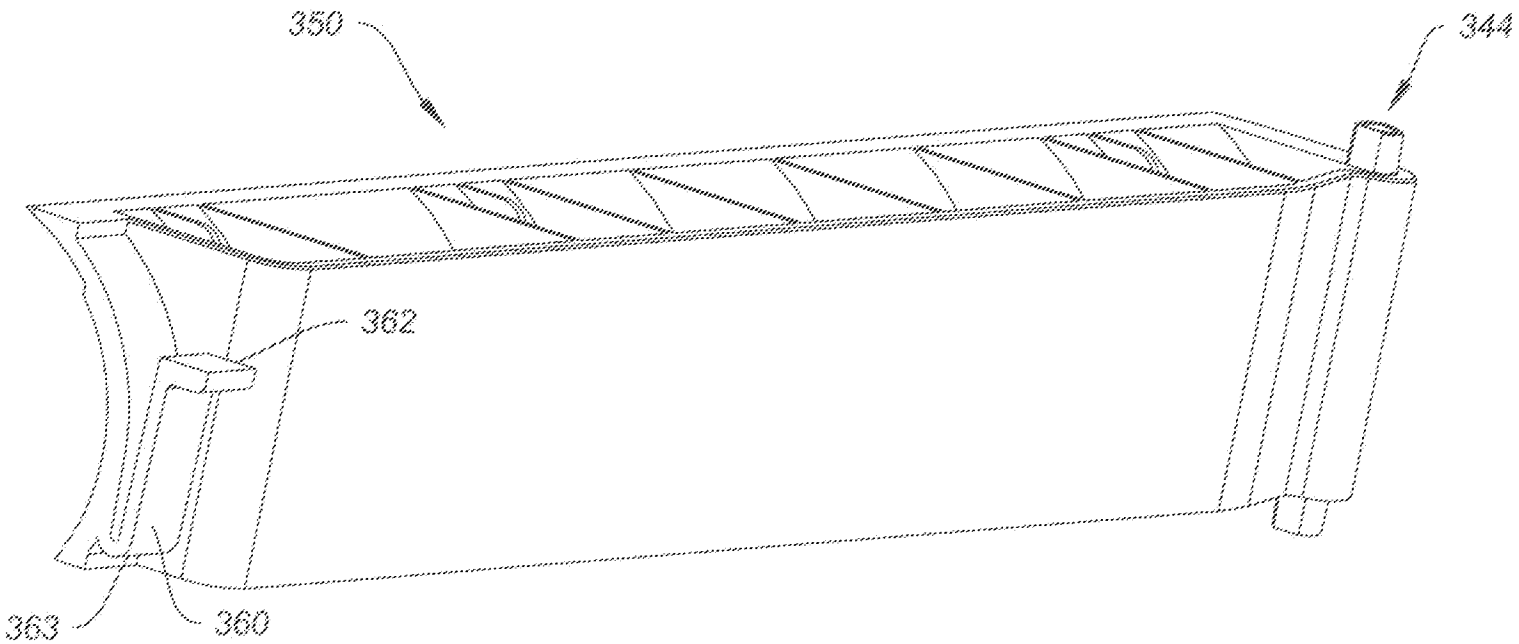
FIG. 11 is a close-up perspective view of the outer side of the pivotable cleanout member.

FIG. 11 shows a close-up perspective view of the outer side of the pivotable cleanout member 350 that is shown in FIG. 5. An alternative embodiment of latch 360 is shown to be formed at one end of pivotable cleanout member 350 opposite pin member 344 of hinge mechanism 340. Pivotable cleanout member 350 and printer housing 319 and their components as described herein are typically formed by injection molding. In the example shown in FIG. 11 and in FIG. 5, latch 360 includes a handle 362 and a living hinge 363 that allows handle 362 to be pulled away from the body of pivotable cleanout member 350 during opening, and pushed in toward the body during closing.

Figure 12:
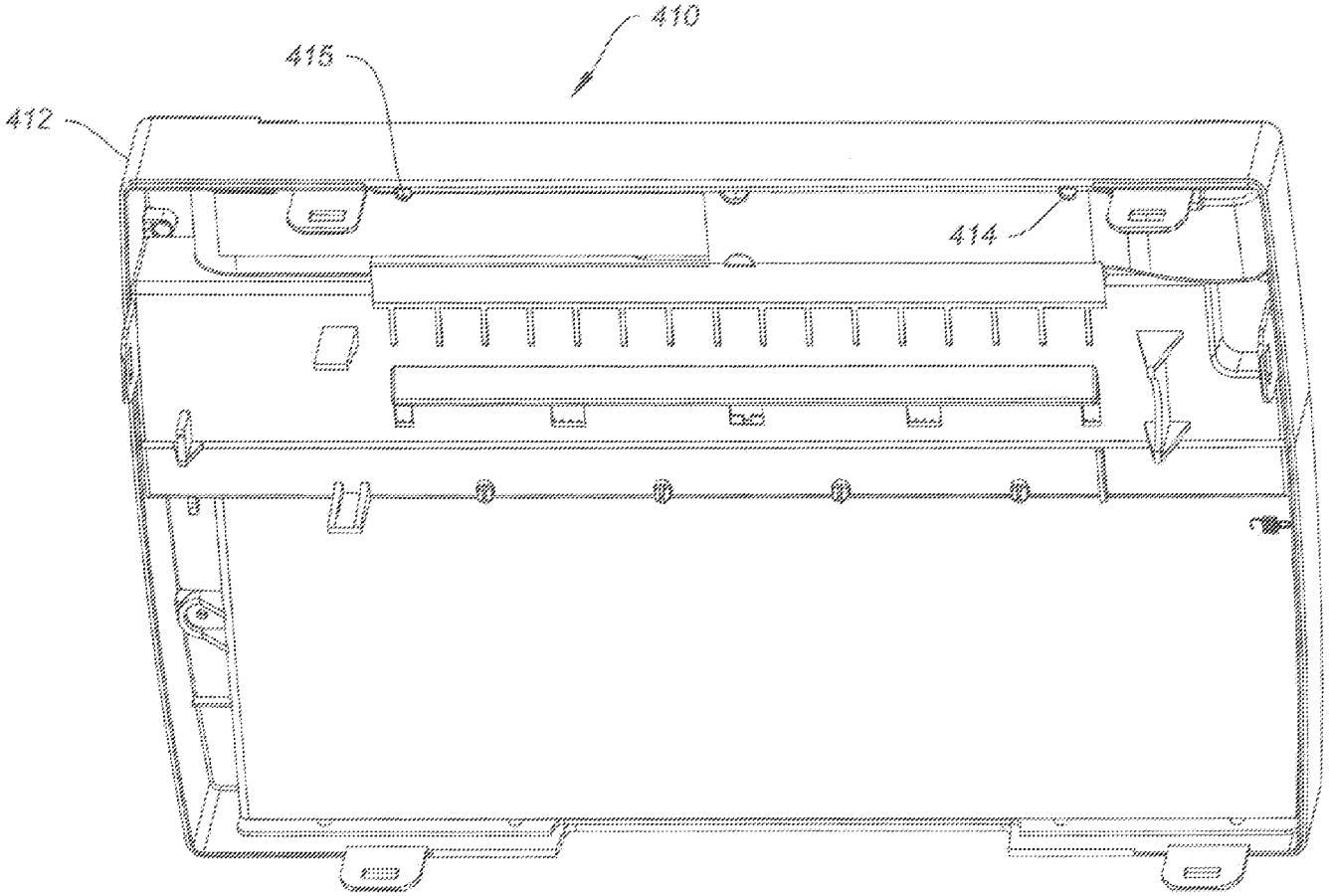
FIG. 12 is a perspective view of the underside of the scanning apparatus of FIG. 5.

FIG. 12 shows an underside of the scanning apparatus 410 that is shown in the FIG. 5 view of multifunction printer 400. In this preferred embodiment, case or housing 412 of scanning apparatus 410 includes a hole 414 for receiving upper second end 348 of pin member 344 (FIGS. 7 and 10). In addition, hole 415 can be used for receiving upper second end of the pin member of the hinge mechanism of the second half door in the half door implementation. In this way, pin member (s) 344 of cleanout member 350 is pivotally mounted between scanning apparatus 410 and printing apparatus 300. This general approach is also disclosed in co-pending U.S. patent application Ser. No. 12/913,115, filed Oct. 27, 2010, entitled "Method of Assembling a Multifunction Printer". In other preferred embodiments of multifunction printers or standalone printers (not including a scanning apparatus) second end 348 of pin member 344 can be captured by a part of the housing of printing apparatus 300.

The invention has been described in detail with particular reference to certain preferred embodiments thereof, but it will be understood that variations and modifications can be effected within the spirit and scope of the invention. In particular, although preferred embodiments were described with regard to inkjet printers, the invention is applicable to other types of printing apparatus as well.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
250 Printhead chassis
251 Printhead die
253 Nozzle array
254 Nozzle array direction
256 Encapsulant
257 Flex circuit
258 Connector board
262 Multi-chamber ink tank
264 Single-chamber ink tank
300 Printing apparatus
301 Base
302 Paper load entry direction
303 Print region
304 Media advance direction
305 Carriage scan direction
306 Right side of printing apparatus
307 Left side of printing apparatus
308 Front of printing apparatus
309 Rear of printing apparatus
310 Hole (for paper advance motor drive gear)
311 Feed roller gear
312 Feed roller
313 Forward rotation direction (of feed roller)
315 Media end sensor
316 Media input holder
317 Inclined guide
318 Media output holder
319 Wall
320 Pick roller
321 Pinch roller
322 Turn roller
323 Idler roller
324 Discharge roller
325 Star wheel(s)
330 Maintenance station
335 Media advance system
340 Hinge

341 Axis (of hinge)
342 Support member (of hinge)
343 Bearing surface
344 Pin member (of hinge)
345 Opening (to receive pin member)
346 Contact surface
347 First end (of pin member)
348 Second end (of pin member)
350 Cleanout member
352 Inner side of (cleanout member)
353 Rib(s)
354 Half door
355 Half door
356 Upper surface (of half door)
357 Guide feature
360 Latch
361 Catch
362 Handle
363 Living hinge
364 Mount(s) (for pinch rollers)
370 Stack of media
371 Top sheet of medium
372 First side (of sheet)
375 Lead edge (of sheet)
380 Carriage motor
382 Carriage guide rail
383 Encoder fence
384 Belt
390 Printer electronics board
392 Cable connectors
400 Multi-function printer
410 Scanning apparatus
412 Case (of scanning apparatus)
414 Hole (in case, or housing, to receive pin member)
415 Hole (in case, or housing, to receive pin member)

The invention claimed is:

1. A printing apparatus comprising:
a base to support the printing apparatus during operation;
a wall extending at an angle from the base;
a print region;
a media input holder, the media input holder being substantially parallel to the base and located at a first plane proximate to the base, and the print region being located at a second plane distal to the base;
a media advance system for advancing media along a media path from the media input holder to the print region, the media advance system comprising:
a pick roller that is driven to advance a sheet of media from the input location;
a turn roller that is driven to further advance the sheet of media received from the pick roller toward the second plane; and
a feed roller that is driven to further advance the sheet of media to the print region for printing; and
a pivotable cleanout member for allowing access to the media path between the media input holder and the print region, wherein the pivotable cleanout member is attached to the wall using a hinge having an axis that is substantially perpendicular to the base and, wherein the turn roller faces an inner side of the pivotable cleanout member when the pivotable cleanout member is in a closed position.

2. The printing apparatus of claim 1 further including a latch for holding the pivotable cleanout member in a closed position relative to the wall of the printing apparatus.

3. The printing apparatus of claim 2, wherein the latch includes a living hinge portion.

4. The printing apparatus of claim 2, the pivotable cleanout member comprising:
a first end including the latch; and
a second end opposite the first end, the second end including a pin member of the hinge.

5. The printing apparatus of claim 1, the wall including a support member of the hinge, and the pivotable cleanout member further comprising a pin member of the hinge for pivoting relative to the support member of the hinge.

6. The printing apparatus of claim 5, wherein the support member of the hinge includes a bearing surface that is substantially parallel to the base, and wherein the pin member includes a contact surface that makes pivotable contact with the bearing surface.

7. The printing apparatus of claim 1, the inner side of the pivotable cleanout member including a curved surface.

8. The printing apparatus of claim 1, the pivotable cleanout member including a pinch roller disposed at the inner side.

9. The printing apparatus of claim 8, wherein the pinch roller is disposed adjacent the turn roller when the pivotable cleanout member is in a closed position.

10. The printing apparatus of claim 1, wherein the pivotable cleanout member includes a first door and a second door.

11. The printing apparatus of claim 10, wherein the first door and the second door are hinged at opposite ends.

12. The printing apparatus of claim 1, the pivotable cleanout member including:
a curved inner side; and
an upper surface disposed distal to the base of the printing apparatus, wherein the upper surface is configured to guide media into the printing apparatus without being advanced past the curved inner side.

13. The printing apparatus of claim 1, the pivotable cleanout member including:
a curved inner side; and
a feature disposed distal to the base of the printing apparatus, wherein the feature is configured to guide media into the printing apparatus without bending the media.

14. A multifunction printer comprising:
a scanning apparatus; and
a printing apparatus comprising:
a base to support the multifunction printer during operation;
a wall extending at an angle from the base;
a print region;
a media input holder;
a media advance system for advancing media along a media path from the media input holder to the print region;
a pivotable cleanout member for allowing access to the media path between the media input holder and the print region, wherein the pivotable cleanout member is attached to the wall using a hinge having an axis that is substantially perpendicular to the base;
the wall including a support member of the hinge;
the pivotable cleanout member including a pin member of the hinge for pivoting relative to the support member of the hinge;
the support member of the hinge including a bearing surface that is substantially parallel to the base; and
the pin member including a first end including a contact surface that makes pivotable contact with the bearing surface, and a second end that is opposite the first end; and
the scanning apparatus comprising a case including a hole, wherein the second end of the pin member is disposed within the hole in the case of the scanning apparatus.

15. The multifunction printer of claim 14, the pivotable cleanout member including:

a curved inner side; and a feature disposed distal to the base of the printing apparatus, wherein the feature is configured to guide media into the printing apparatus without bending the media.

* * * * *